US005685213A

United States Patent [19]

Görl et al.

[11] Patent Number: 5,685,213

[45] Date of Patent: Nov. 11, 1997

[54] DEVICE FOR IN-LINE PERFORATION OF CONTINUOUS WEBS OF MATERIAL

[75] Inventors: Gerhard Görl, Frankenthal; Gerd Raasch, Sandhausen, both of Germany

[73] Assignee: Heidelberger Druckmaschinen AG, Heidelberg, Germany

[21] Appl. No.: 695,701

[22] Filed: Apr. 29, 1996

Related U.S. Application Data

[63] Continuation of Ser. No. 122,772, Sep. 16, 1993, abandoned.

[30] Foreign Application Priority Data

Sep. 16, 1992 [DE] Germany ..... 42 30 938.7

[51] Int. Cl.[6] ..... B26D 1/143

[52] U.S. Cl. ..... 83/346; 83/285; 83/289; 83/156

[58] Field of Search ..... 83/346, 285, 298, 83/302, 315, 289, 344, 345, 337, 156, 660

[56] References Cited

U.S. PATENT DOCUMENTS

| | | | |
|---|---|---|---|
| 2,762,433 | 9/1956 | Russell | 83/660 |
| 3,014,631 | 12/1961 | Fischer et al. . | |
| 4,543,863 | 10/1985 | Rader . | |
| 4,674,371 | 6/1987 | Groth . | |
| 4,805,501 | 2/1989 | Nuttin . | |
| 4,851,763 | 7/1989 | Grützmacher et al. . | |

FOREIGN PATENT DOCUMENTS

| | | |
|---|---|---|
| 2144590 | 8/1973 | Germany . |
| 1216900 | 9/1968 | United Kingdom . |
| 2 078 495 | 1/1982 | United Kingdom . |

*Primary Examiner*—Maurina T. Rachuba
*Attorney, Agent, or Firm*—Herbert L. Lerner; Laurence A. Greenberg

[57] ABSTRACT

Device for in-line perforation of a continuous web of material in a gap between a pair of cylinders, the web being printed on at least one side thereof, both of the cylinders being held in side walls of a perforating unit and being driven, one of the cylinders carrying elements for perforating the web of material, includes a draw roller for drawing the web of material into the perforating unit, and a separate drive motor associated with the perforating unit and connected with the draw roller and the perforating-cylinder pair for simultaneously driving the draw roller and the perforating-cylinder pair.

8 Claims, 6 Drawing Sheets

DEVICE FOR IN-LINE PERFORATION OF CONTINUOUS WEBS OF MATERIAL

This application is a continuation of application Ser. No. 08/122,772, filed Sep. 16, 1993 now abandoned.

SPECIFICATION

The invention relates to a device for in-line perforation, in a gap between two cylinders, of continuous webs of material printed on either one or both sides thereof, both of the cylinders being held in side walls of a perforating unit and being driven, one of the cylinders carrying elements for perforating a web of material.

U.S. Pat. No. 4,674,377 describes a perforating-unit drive in which a differential gear transmission is required in addition to the existing driving gear train, so as to be able to perform a phase adjustment between an input or drive shaft and an output or driven shaft. The input shaft of the differential gear transmission, in turn, is in engagement with an intermediate gear on a side wall through the intermediary of a separate gear train. The equipment proposed for the phase regulation of the perforating cylinder is too elaborate, includes too many individual components and is therefore unable to be manufactured at a favorable cost.

Other drive constructions provide for a branching of a drive from a main drive train of a printing press, for example, a longitudinal shaft, especially rigid against torsion, which is mounted in a plurality of bearings. In this heretofore known example, the drive is transmitted via a bevel-gear transmission from the longitudinal shaft to a clutch in the form of an overload clutch. This configuration likewise necessitates a multiplicity of different components that require much space and that, because of manufacturing-related tolerances, have a considerably adverse effect upon a precise phase regulation of the perforating-cylinder pair.

Proceeding from the hereinafore-outlined disadvantages of the state of the art, it is an object of the invention to provide a device for in-line perforation of continuous webs of material having an improved perforating-unit drive as well as affording an optimization of precise perforation positioning.

With the foregoing and other objects in view, there is provided, in accordance with the invention, a device for in-line perforation of a continuous web of material in a gap between a pair of cylinders, the web being printed on at least one side thereof, both of the cylinders being held in side walls of a perforating unit and being driven, and one of the cylinders carrying elements for perforating the web of material, comprising a draw roller for drawing the web of material into the perforating unit, and a separate drive motor associated with the perforating unit and connected with the draw roller and the perforating-cylinder pair for simultaneously driving the draw roller and the perforating-cylinder pair.

The advantages obtainable with this construction are firstly that, when a separate drive is used, it is possible to dispense with a bevel-gear unit, an overload clutch and longitudinal-shaft branching, which lowers the manufacturing costs. The number of components required for the drive can be reduced to a minimum. Secondly, the use of an economical direct drive permits an independent control and energization of the motor and, therefore, of the perforating unit.

In accordance with another feature of the invention, the drive motor is provided with a torque transmitter for regulating the phase position of the one cylinder carrying the perforating elements during printing-press operation.

The foregoing advantageous construction of the invention provides for the drive motor to have a torque or angle-of-rotation sensor or transmitter, by means of which it is possible to adjust the phase position of the perforating cylinder during printing-press operation. This permits phase regulation of the circumferential register directly via the direct drive.

In accordance with a further feature of the invention, the device includes a current-limiter circuit wherein the drive motor is connected. It is thereby possible to dispense with a mechanical overload clutch of conventional type.

In accordance with an added feature of the invention, the device includes a perforation-depth adjuster for adjusting the gap width between the cylinders of the perforating cylinder pair to the thickness of the web of material. It is accordingly possible to ensure that such webs of material formed of a plurality of component webs which have to be brought together upline of the perforating unit are uniformly perforated through all of the component web layers.

In accordance with an additional feature of the invention, the draw roller is installed in the perforating unit above the perforating-cylinder pair. It is possible thereby to achieve improved guidance of the web, particularly with regard to variations in web tension.

In accordance with yet another feature of the invention, the device includes a guide rail mounted in the perforating unit, and at least one longitudinal cutting wheel axially displaceable on the guide rail so as to be actuatable upon the web of material as it passes over the surface of the draw roller.

In accordance with yet a further feature of the invention, the device includes a guide rail mounted in the perforating unit, and at least one axially positionable press-on element disposed on the guide rail above the draw roller.

In accordance with a concomitant feature of the invention, the device includes an actuating cylinder connected to the one cylinder carrying the perforating elements for adjustably bringing the one cylinder, through the intermediary of a shaft, a lever, adapter sleeves and swivellable eccentric bushings, into engagement with the surface of the other cylinder of the perforating-cylinder pair.

Other features which are considered as characteristic for the invention are set forth in the appended claims.

Although the invention is illustrated and described herein as embodied in a device for in-line perforation of continuous webs of material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
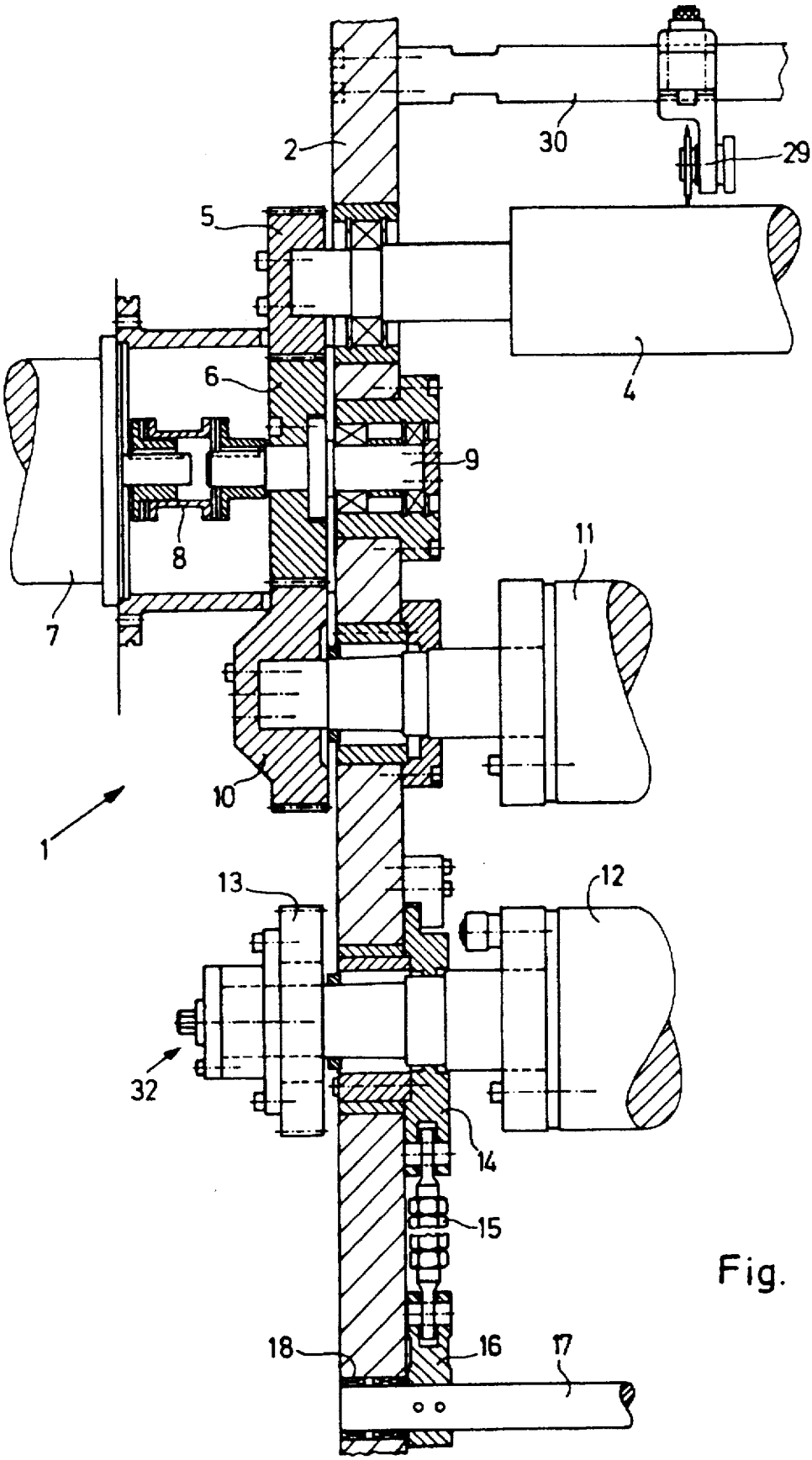
FIGS. 1 and 2 are right-hand and left-hand lapped sectional views, respectively, of the components or internals of the perforating unit according to the invention, projected into the plane of the drawing.
Figure 2:
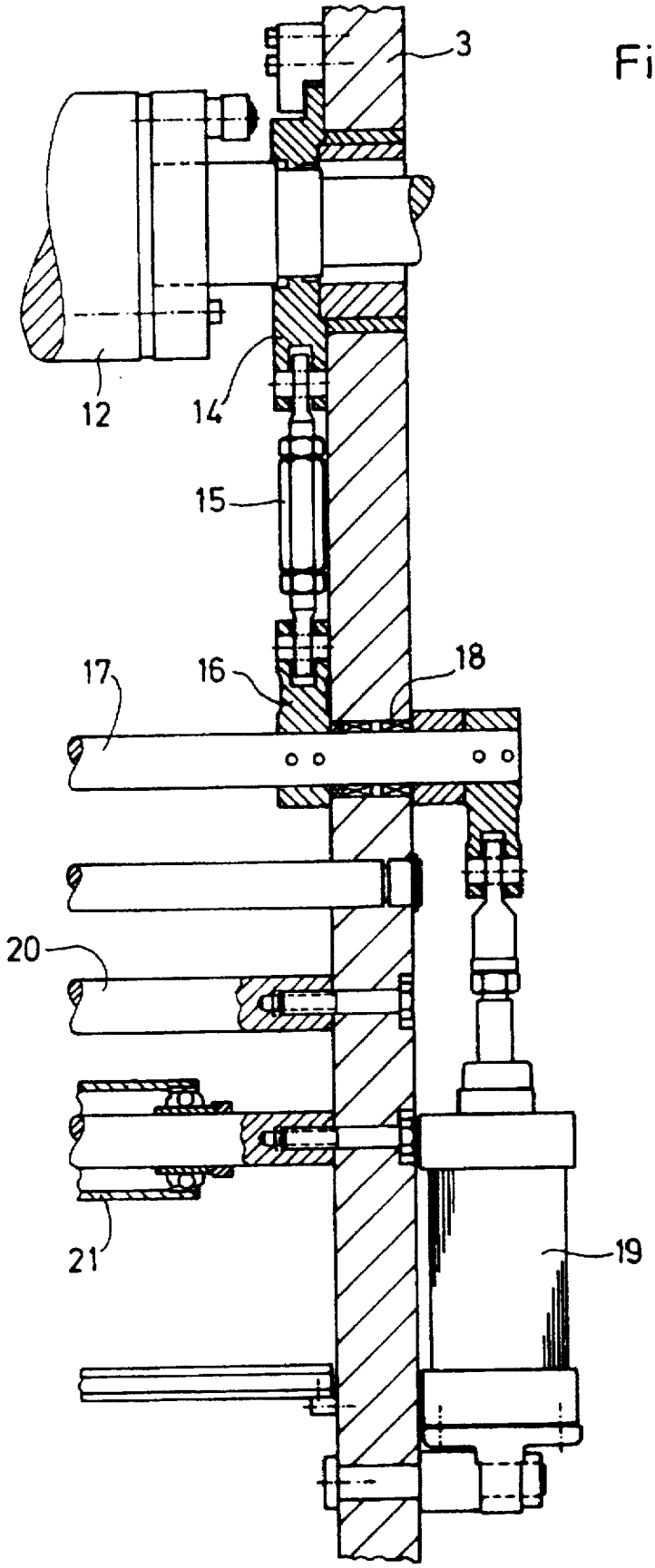

Referring now to the drawings and, first, particularly to FIGS. 1 and 2 thereof, there are shown therein components or internals of a perforating unit according to the invention. The internals are accommodated in the side walls 2 and 3 of the perforating unit 1. Thus, a draw roller 4 is connected to a drive motor 7 through the intermediary of a gearwheel 5 which meshes with a drive gear 6. The drive motor 7 is connected by a sleeve-like clutch 8 to a short shaft mounted in a shaft bearing 9 in the side wall 2, the short shaft, in turn, carrying the drive gear 6. The drive gear 6 meshes with an intermediate gear 10 of a cylinder 11, which is journalled at both ends thereof, respectively, in the side walls 2 and 3 of the perforating unit.

Figure 3:
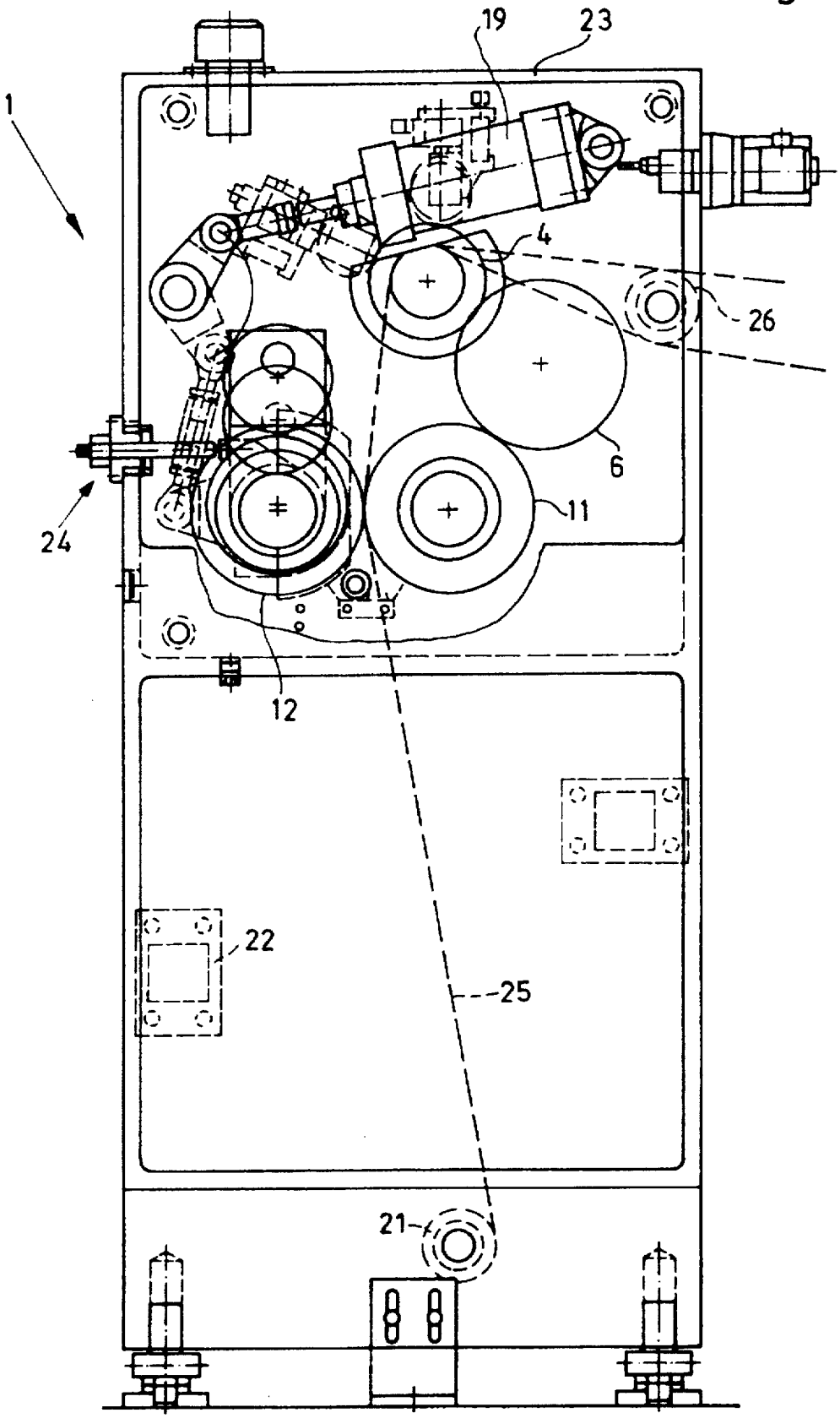
FIG. 3 is a diagrammatic side elevational view of the perforating unit in the vicinity of the side wall at the operator side.
Figure 4:
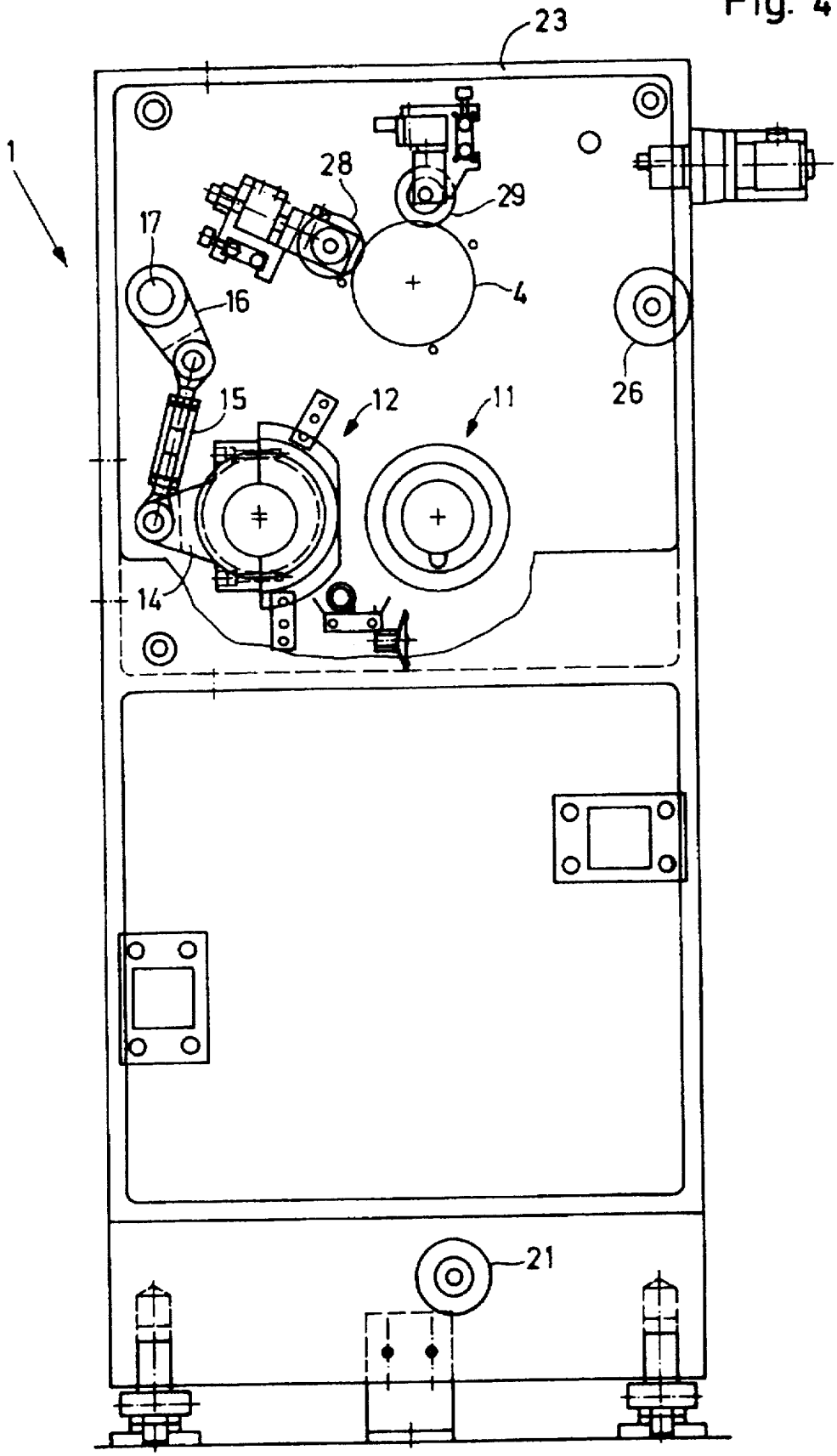
FIG. 4 is a sectional view taken in the middle of the perforating unit of FIG. 3.
Figure 5:
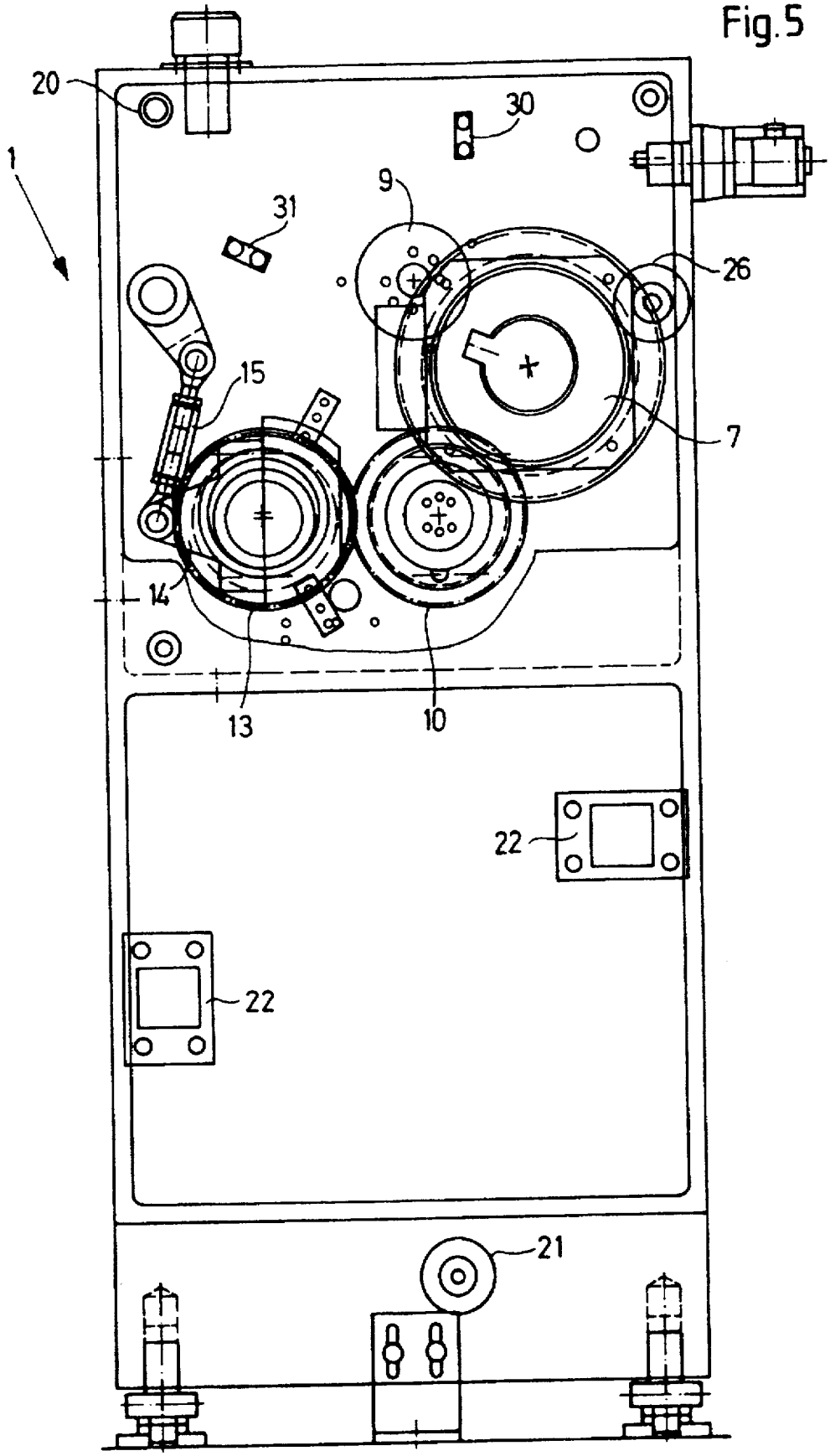
FIG. 5 is a view like that of FIG. 3 of the perforating unit in the vicinity of the side wall at the drive side.

As can be seen particularly clearly in at least one of FIGS. 3, 4 and 5, the intermediate gear 10 meshes with a gearwheel 13 of a perforating cylinder 12. The journals of the perforating cylinder 12 are held at both ends in swivellable eccentric bushings 14 which, in turn, are held in the side walls 2 and 3, and are movable by adapter sleeves 15 attached to levers 16 of a shaft 17. The shaft 17, held by shaft bearings 18 in the side walls 2 and 3, is rotated through the intermediary of an actuating cylinder 19, which is rotatably mounted on the side wall 3 and is pneumatically or hydraulically energizable. The rotation of the shaft 17, acting through the interposed transmission members, causes a swivelling motion of the eccentric bushings 14. In this manner, the perforating cylinder 12 can be brought into or taken out of engagement with the outer cylindrical surface of the cylinder 11.

Due to the projection presented in FIG. 1, the size or width of the gap between the perforating cylinder 12 and the cylinder 11 is greatly exaggerated. It can further be seen from FIG. 1 that the perforating cylinder 12 is furnished with a position corrector 32 at the drive end of the side wall 2. By means of the position corrector 32, the axial position of the perforating cylinder 12 may be adjusted in such a manner that the perforating elements disposed on the circumference thereof, e.g., in the form of perfo-strips or perforating plates, cooperate with a yet unworn surface region of the cylinder 11, which serves as the perforation backing or counter-pressure surface. This makes it possible for the service life of the covering of the cylinder 11 to be considerably increased before a replacement is necessary.

Installed in a lower region of the perforating unit 1 between the side walls 2 and 3 is an infeed roller 21, by means of which a web of material 25 to be processed enters the gap between the perforating cylinder 12 and the cylinder 11. Mounted above the infeed roller 21 is a stiffening cross member or traverse 22 (FIG. 3). Disposed likewise in an upper part of the perforating unit 1 and mounted on one of the side walls 2 and 3, respectively, are two guide rails 30 and 31 (note FIG. 5). Disposed on the guide rail 30 is at least one longitudinal cutting wheel 29, which is adjustable in axial direction. The longitudinal cutting wheel 29 is in engagement with the surface of the draw roller 4 and cuts off a lateral region of the web of material 25. Conversely, disposed on the guide rail 31 is at least one press-on roller 28 (FIG. 4), displaceable in axial direction, which is in engagement with the surface of the draw roller 4 in order to tauten or apply tension to the web of material 25.

Through the intermediary of an angle-of-rotation or torque sensor or transmitter 27, which cooperates with the drive motor 7 and feeds pulses therefrom to the latter, it is possible for the phase position of the perforating cylinder 12 to be changed. A phase lead or a phase lag of the perforating cylinder 12 is thus able to be set, accordingly permitting the phase regulation to be decoupled from the operating cycle of the printing press disposed upline therefrom.

FIG. 3 is a side view of the perforating unit in the vicinity of the side wall at the operator side. The spatial arrangement of the components or internals of the perforating unit 1 is apparent from FIG. 3; also, the path of the web of material 25 through the perforating unit 1 can be seen therein. Accordingly, the actuating cylinder 19, rotatably mounted on the side wall 3 (not shown in FIG. 3), is accommodated above the draw roller 4. The drive gear 6 driven by the drive motor 7 drives the cylinder 11 directly, while the perforating cylinder 12 is driven thereby indirectly. A perforation-depth adjuster 24 is mounted at the web-entry side of the cover 23 of the perforating unit 1. A shaft, provided with a fine-pitch thread, is axially moveable, through the intermediary of a handwheel, in such a manner that it is possible to vary the circumferential position of the eccentric bushings 14 of the perforating cylinder 12, the eccentric bushings 14 being swivellably held in the side walls 2 and 3. The gap between the perforating cylinder 12 and the cylinder 11, through which the web of material 25 must pass, is in this manner adapted to the thickness of the particular web of material 25 being processed, in order to ensure a complete perforation thereof through all of the web layers.

FIG. 4 is a sectional view taken along a central plane of the perforating unit. The levers 16, which are moved by means of the actuating cylinder 19, are swivellable about the shaft 17 and, through the intermediary of the adapter sleeves 15, move the eccentric bushings; in the upper part of the perforating unit are the stops for a rotatable shaft of the perforation-depth adjuster 24. The shaft of the perforation-depth adjuster 24 is braced thereat, and accordingly varies the gap width existing in the perforating-cylinder pair 11, 12, in the desired direction. Disposed above the perforating-cylinder pair 11, 12 is the draw roller 4, which is in engagement with a longitudinal cutting wheel 29 and a press-on roller 28. The web of material 25 oncoming from the driven draw roller 4 can be guided either above or below a discharge roller 26 having a diameter which is approximately equivalent to the diameter of the infeed roller 21, which is provided in the lower part of the perforating unit 1.

FIG. 5 is a side elevational view of the perforating unit in the vicinity of the side wall at the drive side. Near the two guide rails 13 and 31 extending between and to the side walls 2 and 3 are the gearwheel 13 accommodated on the perforating cylinder 12, as well as the gearwheel 10 attached to the cylinder 11, both of the gearwheels 13 and 10 meshing with one another. The drive motor 7, which is separately associated with the perforating unit 1, introduces the drive into the perforating unit i via a clutch 8 (note FIG. 1). The drive gear 6 (not shown in FIG. 5) is mounted behind the shaft bearing 9 in the side wall 2 of the perforating unit 1. Assembly or installation devices of the perforating unit are further indicated adjacent the cross members 20 and the infeed roller 21 extending across the width of the perforating unit 1, and are located in the lower part of the perforating unit.

Figure 6:
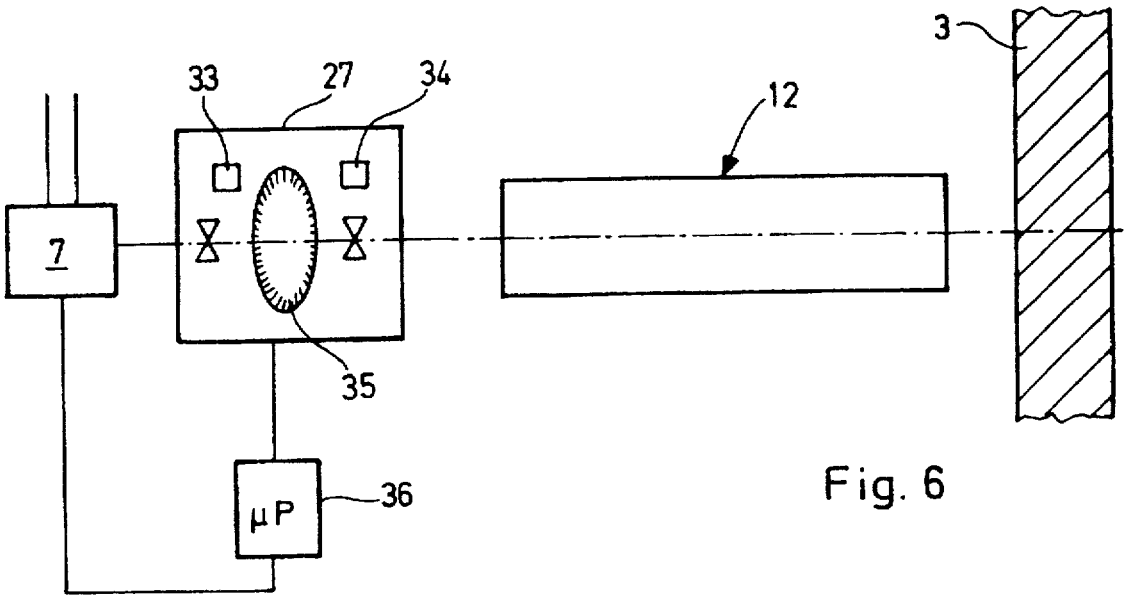
FIG. 6 is a diagrammatic and schematic representation of an arrangement of an angle-of-rotation or torque sensor or transmitter forming part of the invention.

FIG. 6 shows a schematically represented arrangement of an angle-of-rotation sensor or transmitter 27 accommodated in a housing and mounted on the journal of the perforating cylinder 12. Both a light source 33 and a receiving sensor 34 are disposed in the housing in order to ascertain the rotational position of a corresponding cylinder, by means of an encoding disk 35. The pulses from the angle-of-rotation sensor 27 are superimposed, through the intermediary of a logic circuit 36, upon the drive motor 7. By means of these pulses and the energization of the motor 7 from a central control console of the printing press, it is possible to set an appropriate phase lead or phase lag of the perforating cylinder 12.

Figure 7:
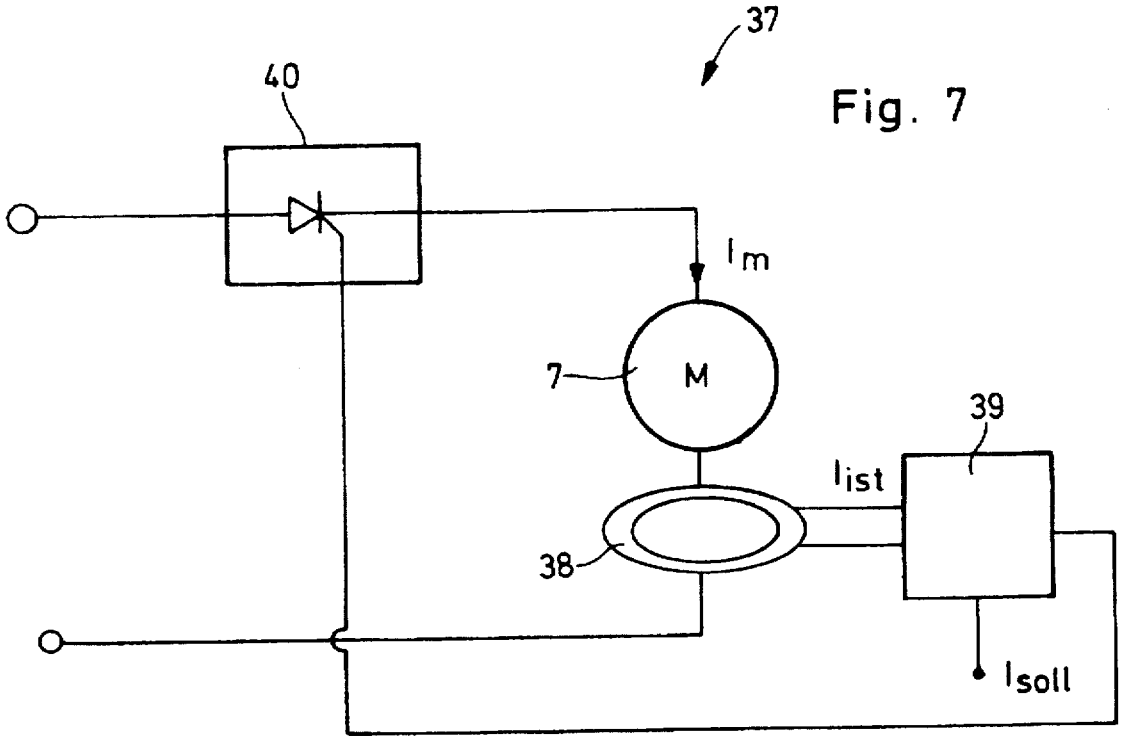
FIG. 7 is a circuit diagram of a current-limiter circuit for a drive motor forming part of the invention.

FIG. 7 shows a current limiter circuit 37 in a relatively simplified form. The purpose of the circuit 37 is to replace a conventional mechanical overload clutch for protecting the drive motor 7 from overloading. The current $I_m$ flowing in the drive motor 7 is supplied as an actual current $I_{act}$ via a current transformer 38, such as an operational amplifier, for example, to a control circuit 39. The control circuit 39 may operate, for example, in accordance with the principle of threshold-value comparison with a prescribed nominal current $I_{nom}$. Depending upon the result of the comparison, the power electronics 40, for example, a thyristor, is controlled for the purpose of limiting the drivemotor current $I_m$.

The foregoing is a description corresponding in substance to German Application P 42 30 938.7, dated Sep. 16, 1992, the International priority of which is being claimed for the instant application, and which is hereby made part of this application. Any material discrepancies between the foregoing specification and the aforementioned corresponding German application are to be resolved in favor of the latter.

We claim:

1. In a perforating unit of a printing machine, a device for in-line perforation of a continuous web of material in a gap between a pair of cylinders, the web being printed on at least one side thereof, both of the cylinders being held in side walls of the perforating unit and being driven, and one of the cylinders carrying elements for perforating the web of material, comprising a draw roller disposed downstream of the perforating-cylinder pair as seen in the direction of travel of the web of material for drawing the web of material through the perforating, and for holding the web of material taut and for deflecting the web away from the perforating unit, and a drive motor exclusively associated with the perforating unit and connected with said draw roller and the perforating-cylinder pair for simultaneously driving said draw roller and the perforating-cylinder pair, and an angle of rotation sensor disposed at said perforating-cylinder pair for setting a phase lead or phase lag of said perforating cylinder via said drive motor.

2. Device according to claim 1, wherein said drive motor is provided with a torque transmitter for regulating the phase position of the one cylinder carrying the perforating elements during printing-press operation.

3. Device according to claim 1, wherein said drive motor is provided with a current-limiter circuit.

4. Device according to claim 1, including a perforation-depth adjuster for adjusting the gap width between the cylinders of the perforating-cylinder pair to the thickness of the web of material.

5. Device according to claim 1, wherein said draw roller is installed in the perforating unit above the perforating-cylinder pair.

6. Device according to claim 5, including a guide rail mounted in the perforating unit, and at least one longitudinal cutting wheel axially displaceable on said guide rail so as to be actuatable upon the web of material as it passes over the surface of said draw roller.

7. Device according to claim 5, including a guide rail mounted in the perforating unit, and at least one axially positionable press-on element disposed on said guide rail above said draw roller.

8. Device according to claim 1, including an actuating cylinder connected to the one cylinder carrying the perforating elements for adjustably bringing the one cylinder, through the intermediary of a shaft, a lever, adapter sleeves and swivellable eccentric bushings, into engagement with the surface of the other cylinder of the perforating-cylinder pair.

* * * * *